US010946665B2

(12) United States Patent
Janssen et al.

(10) Patent No.: US 10,946,665 B2
(45) Date of Patent: Mar. 16, 2021

(54) DETERMINING AN OUT-OF-LIQUID CONDITION

(71) Applicant: Hewlett-Packard Development Company, L.P., Spring, TX (US)

(72) Inventors: Matthew Jason Janssen, Corvallis, OR (US); James William Ring, Corvallis, OR (US); James Ronald Cole, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/614,992

(22) PCT Filed: Jul. 12, 2017

(86) PCT No.: PCT/US2017/041728

§ 371 (c)(1),
(2) Date: Nov. 19, 2019

(87) PCT Pub. No.: WO2019/013780

PCT Pub. Date: Jan. 17, 2019

(65) Prior Publication Data

US 2020/0180319 A1 Jun. 11, 2020

(51) Int. Cl.
*B41J 2/175* (2006.01)
*B41J 29/393* (2006.01)

(52) U.S. Cl.
CPC ..... *B41J 2/17566* (2013.01); *B41J 2/17556* (2013.01); *B41J 2/17596* (2013.01); *B41J 29/393* (2013.01)

(58) Field of Classification Search
CPC .... B41J 2/175; B41J 2/17513; B41J 2/17556; B41J 2/17566; B41J 2/17596; B41J 29/393
See application file for complete search history.

(56) References Cited

U.S. PATENT DOCUMENTS 6,435,638 B1 8/2002 Wilson et al.
6,454,375 B2 9/2002 Wilson et al.
(Continued)

FOREIGN PATENT DOCUMENTS

EP 1203666 5/2002
EP 1013447 6/2012

OTHER PUBLICATIONS

Epson Exceed Your Vision, "Epson Provides the Best Inks for the Job", 2017, https://www.epson.co.nz/microsite/excellence/inks_why.asp.

(Continued)

*Primary Examiner* — Anh T Vo
(74) *Attorney, Agent, or Firm* — Robert Sismilich

(57) ABSTRACT

In one example, a method for determining an out-of-liquid condition of a liquid supply for an inkjet printer. The method includes acquiring, during printing, a sequence of data points, each data point comprising a differential liquid/air pressure at the liquid supply measured with a sensor and a corresponding cumulative amount of liquid delivered from the liquid supply. The method further includes generating a curve using the data points. The method also includes determining, from a predetermined characteristic of the curve, whether the out-of-liquid condition exists. The characteristic is independent of at least one of a gain and an offset of the sensor.

15 Claims, 7 Drawing Sheets

(56) References Cited

U.S. PATENT DOCUMENTS

| | | | | |
|---|---|---|---|---|
| 8,235,482 | B2 | 8/2012 | Katada | |
| 2002/0012016 | A1 | 1/2002 | Wilson et al. | |
| 2002/0024543 | A1* | 2/2002 | Kimura | B41J 2/17513 347/7 |
| 2009/0237426 | A1 | 9/2009 | Kimura | |
| 2015/0015631 | A1* | 1/2015 | Lyman | B41J 2/04501 347/14 |
| 2017/0008297 | A1 | 1/2017 | Navarro et al. | |

OTHER PUBLICATIONS

HP, "HP Printers—How to Check Ink or Toner Levels", 2016, https://support.hp.com/in-en/document/c04927206.

* cited by examiner

200

300

DETERMINING AN OUT-OF-LIQUID CONDITION

BACKGROUND

Inkjet printing systems and devices utilize a supply of a liquid (in some cases an ink) which is controllably ejected from a printhead onto a medium. The supply may be replaced or replenished when, or just before, the supply becomes exhausted. Receiving an accurate notification of an out-of-liquid condition ("OOL") enables a user to do so in a timely manner, without improper print output or damage to the printhead or other components, and in a cost-effective and environmentally friendly manner that does not strand significant amounts of unused printing liquid in a replaced component.

DETAILED DESCRIPTION

Figure 1B:
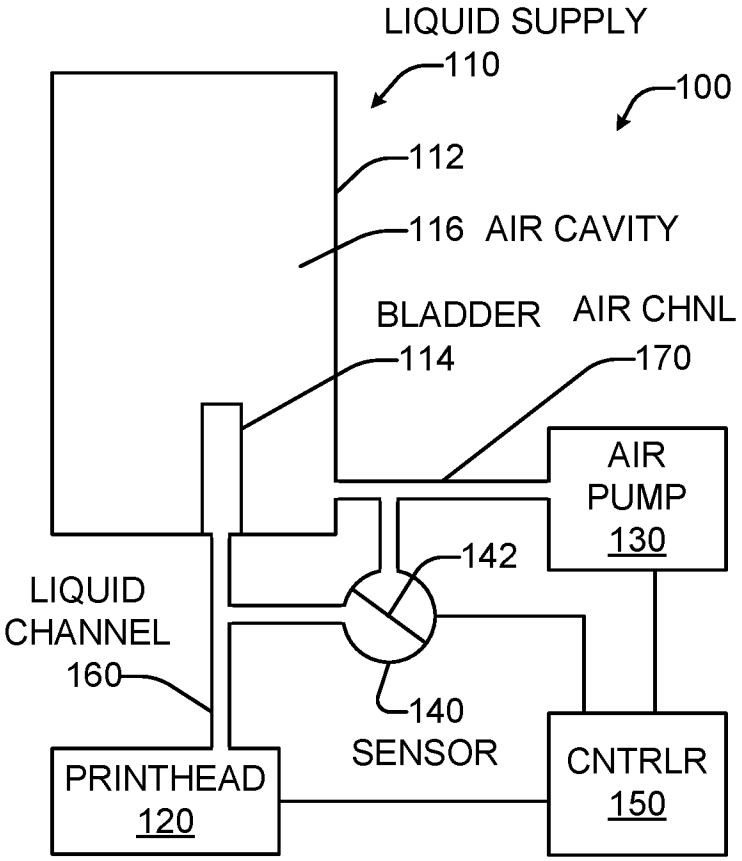
FIG. 1B is a schematic representation of an inkjet printing device having a relatively empty liquid supply in accordance with an example of the present disclosure.

In inkjet printing systems and devices, a liquid is controllably ejected from a printhead onto a medium. As defined herein and in the appended claims, a "liquid" may be broadly understood to mean a fluid in liquid form, not composed primarily of a gas or gases, that is amenable to controlled ejection from an inkjet printhead. The liquid may be referred to as a printing liquid, which in some cases is an ink. Thus a "liquid" may encompass printing liquids of various visible colors, invisible printing liquids, liquids usable in additive manufacturing or 3D printing including as agents, and/or liquids used for applications other than printing. The medium may be any type of suitable medium for receiving the ejected liquid, including sheet or roll material, such as paper, card stock, cloth or other fabric, transparencies, mylar, among others; powdered material usable to fabricate 3D objects; or other types of media.

A variety of inkjet printing devices are commercially available. For instance, some of the printing devices in which the present disclosure may be implemented include inkjet printers, plotters, portable printing units, copiers, cameras, video printers, facsimile machines, all-in-one devices (e.g. a combination of at least two of a printer, scanner, copier, and fax), additive manufacturing systems, 3D printers, and many others.

Many inkjet printing systems and devices use liquid supplies which are separate from the printhead. In some cases, these are referred to as bulk liquid systems in which the liquid supply may be replaced when exhausted by a new liquid supply, but the same printhead continues to be used. In some systems, pressurized air is used to exert pressure on a component of a liquid supply to in turn pressurize the liquid for delivery from the supply to the printhead. In some examples, the differential pressure between the pressurized air and the pressurized liquid (referred to herein as "differential liquid/air pressure") at the liquid supply varies according to the percentage of liquid delivered from the liquid supply. In some examples, the relationship between differential liquid/air pressure and delivered liquid is a curve of a characteristic shape. In such examples, differential liquid/air pressure begins at approximately zero for a full liquid supply, and rises quite slowly and substantially linearly until a certain percentage of liquid (60% to 80% in some examples) has been delivered from the liquid supply. Next, an exponential rise in differential liquid/air pressure occurs with increased delivery of liquid from the supply. When the supply approaches and reaches exhaustion, differential liquid/air pressure levels off at a maximum differential pressure. A differential liquid/air pressure sensor is commonly used to measure differential liquid/air pressure.

The printheads of some systems may become damaged if the ejection elements of the printhead are operated without liquid present. As a result, such systems may use the exponential rise to determine OOL. For example, they may measure differential liquid/air pressure during printing, and when the differential liquid/air pressure reaches or exceeds a predetermined threshold value somewhere along the exponential portion of the curve between zero and maximum differential liquid/air pressure, OOL is declared. Due to the steep slope of the differential liquid/air pressure vs. delivered liquid curve in the exponential region, delivery of a relatively small amount of additional liquid from the liquid supply can quickly result in exhaustion, and so an accurate measurement of differential liquid/air pressure is used to ensure that the printheads do not become starved of liquid. To achieve a sufficient accuracy, the gain and DC offset of a differential liquid/air pressure sensor may be characterized at the factory and/or calibrated during use in the field. However, these steps can add cost to the manufacturing process, add complexity to OOL detection, and/or rely on calibration operations performed by the user.

One core concept of the present disclosure is to provide an inkjet printing device, method, and/or storage medium which accurately determines OOL without relying on the absolute accuracy of a measured differential liquid/air pressure value. This advantageously allows a less-expensive, less-accurate differential liquid/air pressure sensor to be used without gain and DC offset calibration. It may also advantageously allow for the OOL detection point to be selected from a range of amounts of delivered liquid (i.e. over a range of delivered liquid values prior to complete exhaustion of the liquid supply).

Referring now to the drawings, there is illustrated an example of an inkjet printing device which determines when an OOL condition of the liquid supply occurs using a differential liquid/air pressure sensor whose gain and DC offset have not been characterized or calibrated (i.e. the gain and DC offset are indeterminate). The differential liquid/air pressure is periodically measured with the differential liquid/air pressure sensor, and measurements are correlated to a corresponding cumulative amount of liquid delivered from the liquid supply at the time of the measurements. A curve is generated from the measured differential pressures and the correlated cumulative amounts of delivered ink, and the occurrence of an out-of-liquid condition is determined from a predetermined characteristic of the curve.

Figure 1A:
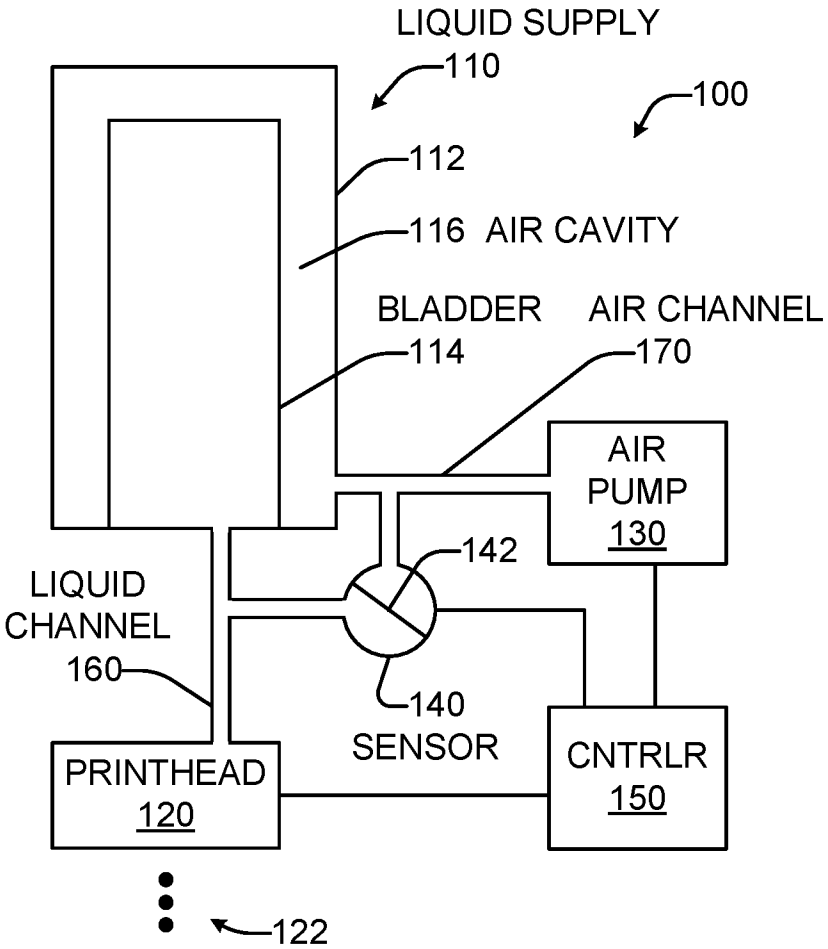
FIG. 1A is a schematic representation of an inkjet printing device having a relatively full liquid supply in accordance with an example of the present disclosure.

Considering now an inkjet printing device, and with reference to FIGS. 1A-1B, an example inkjet printing device 100 includes a receptacle (not shown) to receive a liquid supply 110 installed in the device 100, a printhead 120, an air pump 130, a differential liquid/air pressure sensor 140, and a controller 150.

The liquid supply 110 has a rigid outer structure 112. A deformable inner container 114 (which may be referred to as a "bladder" or "bag") of the liquid supply 110 houses the liquid. The liquid container 114 is spaced apart from the interior of the outer structure 112 at least at some places to form an air cavity 116. In some examples, the liquid supply 110 is replenishable with additional liquid. In some examples, the liquid supply 110 is removable from the printing device 100 and replaceable with a new liquid supply 110.

A liquid channel 160 fluidically couples the liquid supply 110 to the printhead 120, which contains inkjet ejection elements (not shown) which selectively eject drops of the liquid as instructed by a controller. In some examples, this controller is the controller 150. In some examples, such as with bulk liquid supplies, the printhead 120 is external to the liquid supply 110, such that a replacement liquid supply 110 connects to an existing printhead 120 in the printing device 100. In other examples, the printhead 120 and the liquid supply 110 are disposed in a common structure as a combination liquid supply and printhead. The printing device 100 may include a valve (not shown) disposed in the liquid channel 160 to isolate the liquid channel 160 and printhead 120 from the liquid supply 110 while the liquid supply 110 is being replaced.

An air channel 170 couples the air pump 130 to the air cavity 116 of the liquid supply 110. The controller 150 operates the air pump 130 to pressurize the air cavity 116 above atmospheric pressure. In various examples, the air cavity 116 may be pressurized to 4 psi, 6 psi, or another pressure. In some examples, the air pump 130 includes, or is coupled to, an air pressure sensor (not shown) usable by the controller 150 to maintain the intended pressure in the air cavity 116 as liquid is delivered from the liquid supply 110 to the printhead 120 during printing.

The differential liquid/air pressure sensor 140 is coupled to the liquid channel 160 and the air channel 170. A diaphragm 142 or other element forms at least part of a barrier that separates the liquid and the air within the sensor 140, and senses the differential liquid/air pressure. The sensor 140 converts this differential pressure to an electrical signal which is provided to the controller 150. One example sensor usable with the present disclosure is the Silicon Microstructures Incorporated SM5102. This is a piezoresistive pressure sensing device that has about 100 mV of full-scale output, and a DC offset of −50 to +50 mV.

FIG. 1A illustrates the liquid supply 110 in a state where a relatively small percentage of the liquid in the container 114 has been delivered by the liquid supply 110, while FIG. 1B illustrates the liquid supply 110 in a state where a relatively large percentage of the liquid in the container 114 has been delivered by the liquid supply 110. During operation of the printing device 100, the pressurized air in the air cavity 116 exerts pressure on the deformable container 114, tending to force liquid out of the liquid supply 110 into the liquid channel 160 and to the printhead 120, where it remains until the controller 150 operates the printhead 120 to eject drops 122 of the liquid. While a significant amount of liquid still remains in the container 114, the pressure in the liquid channel 160 remains about the same as the pressure in the air channel 170. As a result, the differential liquid/air pressure is close to zero.

As liquid is delivered from the liquid supply 110, the container 114 becomes deformed by the pressurized air in the cavity 116 and the volume occupied by the container 114 in the cavity 116 is reduced, as governed at least in part by the amount of liquid remaining in the container 114. As the container 114 approaches the empty state, the pressure in the liquid channel 160 falls exponentially until the container 114 becomes completely empty. As a result, the differential liquid/air pressure exponentially rises until the container 114 becomes completely empty.

The controller 150 is communicatively coupled to the air pump 130, to pressurize the air cavity 116 and maintain it at a desired pressure; the printhead 120, to control the ejection of liquid drops from the printhead 120; and the differential liquid/air pressure sensor 140, to monitor the differential liquid/air pressure and detect the occurrence of an out-of-liquid condition. In some examples, the controller 150 is implemented in hardware. In other examples, the controller 150 is implemented in a combination of hardware and firmware or software.

In operation, the controller 150 periodically measures, during printing, the differential ink/air pressure between the liquid channel 160 and the air channel 170 using the differential pressure sensor 140. The sensor 140 has an indeterminate gain and DC offset, as characterization and calibration of the sensor 140 is not performed. The sensor 140 is disposed at the liquid supply 110, in order to measure the differential pressure at the liquid supply 110. As defined herein and in the appended claims, a sensor disposed "at" a liquid supply may be broadly understood to mean a sensor disposed near or in the liquid supply. In one example, the sensor 140 disposed at the liquid supply is disposed within the liquid supply 110, and thus is replaced if the liquid supply 110 is replaced. In another example, the sensor 140 disposed at the liquid supply is disposed within the printing device 100 in sufficiently close proximity to the liquid supply 110 such that the liquid pressure at the sensor 140 represents the pressure at the supply 110, and the sensor 140 can measure the differential pressure at the liquid supply 110. In this latter example, the sensor 140 is not replaced by replacing the liquid supply 110.

The controller 150 then correlates each measured pressure to a cumulative amount of liquid delivered from the liquid supply 110. In some examples, the controller 150 calculates the cumulative amount of liquid delivered at the time of a sensor measurement. For example, the controller 150 may maintain a cumulative count of the number of drops ejected from the printhead 120 and, based on a known drop volume and the known volume of liquid in a full liquid supply 110, calculate the cumulative delivered volume and/or percentage of liquid at the time of a sensor measurement. In some examples, a sensor measurement and its associated cumulative amount of delivered liquid form a data point. Although the drop counting technique is not accurate enough for reliable OOL determination, it is sufficiently accurate for determination of the curve characteristics as described here.

The controller 150 further generates a curve from the measured pressures and the correlated cumulative amounts of delivered liquid. In some examples, the curve is generated in real-time during printing. The controller 150 then determines, from a predetermined characteristic of this curve, when an out-of-liquid condition of the liquid supply occurs. For example, during printing the controller 150 repetitively determines whether the OOL condition has yet occurred. After the OOL condition has been detected or determined, the printing device 100 may stop printing, may inform the user that the liquid supply 110 needs replacement or replenishment, and/or may take other actions.

The curve may be generated in a variety of ways, and a variety of characteristics of various curves may be used to determine the OOL condition, as is discussed subsequently.

Figure 2:
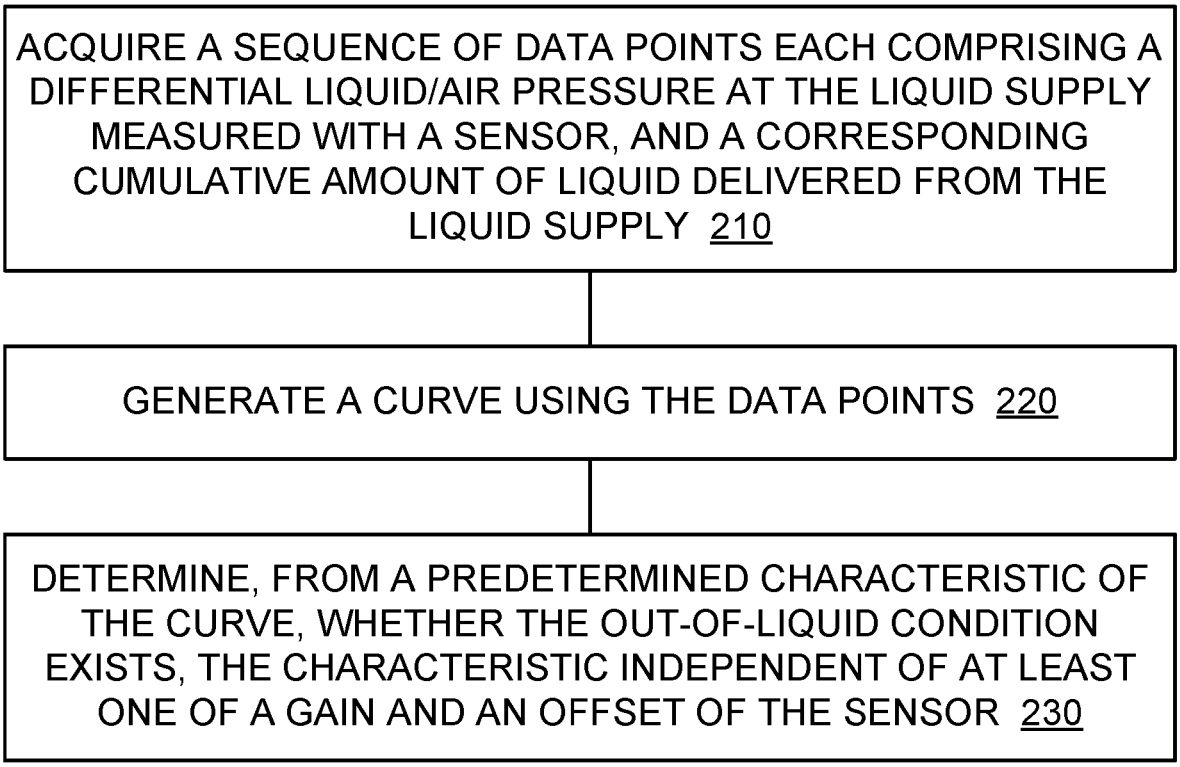
FIG. 2 is a flowchart in accordance with an example of the present disclosure of a method for determining an out-of-liquid condition of a liquid supply for an inkjet printer.

Considering now one method for determining an out-of-liquid condition of a liquid supply for an inkjet printer, and with reference to FIG. 2, a method 200 begins at 210 by acquiring, during printing, a sequence of data points, each data point comprising a differential liquid/air pressure at the liquid supply measured with a sensor and a corresponding cumulative amount of liquid delivered from the liquid supply. At 220, a curve is generated using the data points. At 230, the method determines, from a predetermined characteristic of the curve, whether the out-of-liquid condition exists. The characteristic is independent of at least one of a gain and a DC offset of the sensor. In some examples, the out-of-liquid condition is determined to exist upon detection of the characteristic of the curve. In some examples, the out-of-liquid condition is determined to exist after delivery of a predetermined additional amount of liquid from the liquid supply after detection of the characteristic of the curve. In some examples, the method is performed using, or performed by, the inkjet printing device 100 (FIGS. 1A-1B).

Considering now another method for determining an out-of-liquid condition of a liquid supply for an inkjet printer, and with reference to FIG. 2, a method 300 includes blocks 310, 320, 330 which may be the same as or similar to blocks 210, 220, 230 (FIG. 2) respectively. In some examples, at 322, the curve generated using the data points is, or corresponds to, a plot of a first, second, or higher-order derivative of the differential liquid/air pressure versus the cumulative amount of delivered liquid. In some examples, at 332, the predetermined characteristic of the curve used in conjunction with determining whether the out-of-liquid condition exists is a peak value of the curve; a zero value of the curve following a peak value of the curve; a negative-going spike of the curve below a baseline; a negative-going spike of the curve below a baseline preceded by a positive-going spike of the curve above the baseline; a return to a baseline following a negative-going spike of the curve below the baseline; or maintenance of a value within a predefined tolerance during the delivery of a predetermined additional amount of liquid from the liquid supply following after an exponential rise above a linear range. In other examples, the predetermined characteristic may be a different characteristic of the curve.

Figure 4:
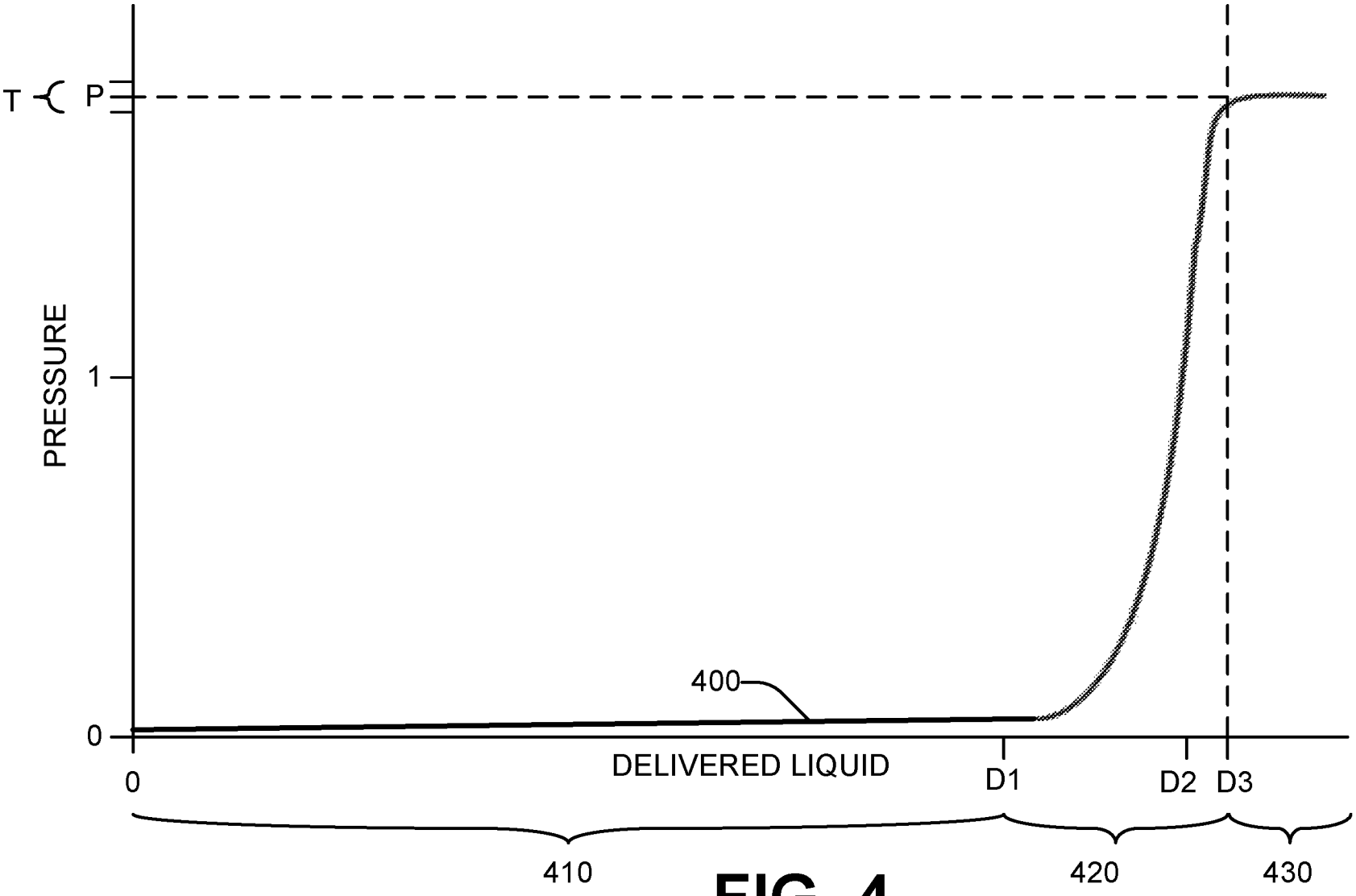
FIG. 4 is an example differential liquid/air pressure curve which represents the differential liquid/air pressure versus the cumulative amount of liquid delivered from a liquid supply for an inkjet printer, in accordance with an example of the present disclosure.

Considering now one example differential liquid/air pressure curve, and with reference to FIG. 4, a curve 400 represents the differential liquid/air pressure versus the cumulative amount of liquid delivered from the liquid supply. The curve 400 has an initial substantially linear segment 410, an exponential segment 420, and a substantially constant pressure segment 430. As has been discussed heretofore, as a liquid supply approaches empty, an exponential rise in the differential liquid/air pressure versus the cumulative amount of delivered liquid occurs. Differential liquid/air pressure measurements are periodically obtained during the printing process, and correlated to a corresponding cumulative amount of liquid that has been delivered from the liquid supply at the time of the measurement. Each differential liquid/air pressure measurement is paired with its corresponding cumulative amount of delivered liquid to form a corresponding two-dimensional data point. In some examples, filtering may be applied to the differential liquid/air pressure measurements to reduce or eliminate noise in the measured differential pressure. In some examples, the filtering may be low-pass filtering, which in one example may be implemented by averaging a number of successive measurements and assigning a value of cumulative amount of delivered liquid to the averaged value. Other filtering methods could also be employed.

The initial linear segment 410 has a differential liquid/air pressure that begins at, or very close to, zero when the liquid supply is completely full (i.e. zero delivered ink). The slope of the curve as liquid is delivered from the in supply is extremely shallow in the segment 410; there is a very slight increase in differential pressure until a cumulative amount D1 of liquid has been delivered from the liquid supply. The linear segment 410 ends at delivered liquid value D1.

The exponential segment 420 begins at the cumulative amount D1 of delivered ink, and continues until a cumulative amount D3 of liquid has been delivered from the liquid supply. The cumulative amount D1 may occur after 60% to 75% of the total liquid in the liquid supply has been delivered, and the D1 point may depend on the liquid capacity of the liquid supply (i.e. the amount of liquid contained in the supply when it is full).

In some examples, delivered liquid value D3 corresponds to a completely empty liquid supply, or to an almost completely empty liquid supply. In constant pressure segment 430, after liquid value D3, additional measurements of differential liquid/air pressure during printing remain within a tolerance band T of a terminal differential liquid/air pressure P.

In some systems, a predetermined differential liquid/air pressure value that occurs in the exponential segment 420 may be used to determine an out-of-liquid condition. For example, a differential liquid/air pressure of 1 psi may be specified, and this pressure corresponds to a cumulative delivered liquid value D2, which in some examples may occur at or near a steepest portion of the exponential segment 420. However, to accurately detect a pressure of 1 psi (or any particular value) a calibrated sensor with a known gain and DC offset would be used, which can be undesirable for reasons discussed heretofore. Furthermore, in some examples the pressure value P is not known and/or may not be consistent from liquid supply to liquid supply, or for different inkjet printing devices, and could not be accurately detected, and so a lower pressure (e.g. 1 psi) is chosen. However, this lower pressure may disadvantageously strand an excessive amount of unused liquid in the liquid supply. In some examples, this may range from about 2.5% to 6.7% of the total amount of liquid in the liquid supply, and may be dependent on the liquid capacity of the liquid supply.

Therefore, in some examples, the out-of-liquid condition is determined to exist if the measured differential liquid/air pressure during printing remains constant, within a predefined pressure tolerance, after the exponential rise 420 in the differential liquid/air pressure above the linear range 410 has occurred. For example, in the constant pressure segment 430, during additional printing the pressure remains within a tolerance band T of some pressure P. The actual value of the pressure P is not relevant, because declaring an out-of-liquid condition depends on a characteristic of the curve, not a pressure value. In this case, the characteristic is the pressure remaining constant, within a tolerance band, during printing (after the segment 420). In one example, the differential liquid/air pressure value P corresponds to an analog saturation value of the sensor 140. In another example, the differential liquid/air pressure value P corresponds to a maximum digital output value of the sensor 140. In yet another example, the particular differential liquid/air pressure P value is less than the analog saturation value and the maximum digital output value.

In another example, the out-of-liquid condition is determined to exist if the measured differential liquid/air pressure rises to the analog saturation value of the sensor 140 or the maximum digital output value of the sensor 140 at any time during printing. In this example, printing stops as soon as the analog saturation value or the maximum digital output value is detected.

In constant pressure segment 430, the liquid supply becomes completely empty at, or soon after, cumulative delivered liquid amount D3. Thus if printing continues, the printheads should be of a type that is resistant to damage if starved of ink, and/or the inkjet printing device should provide an environment in which the printheads avoid being completely starved of liquid.

Figure 5:
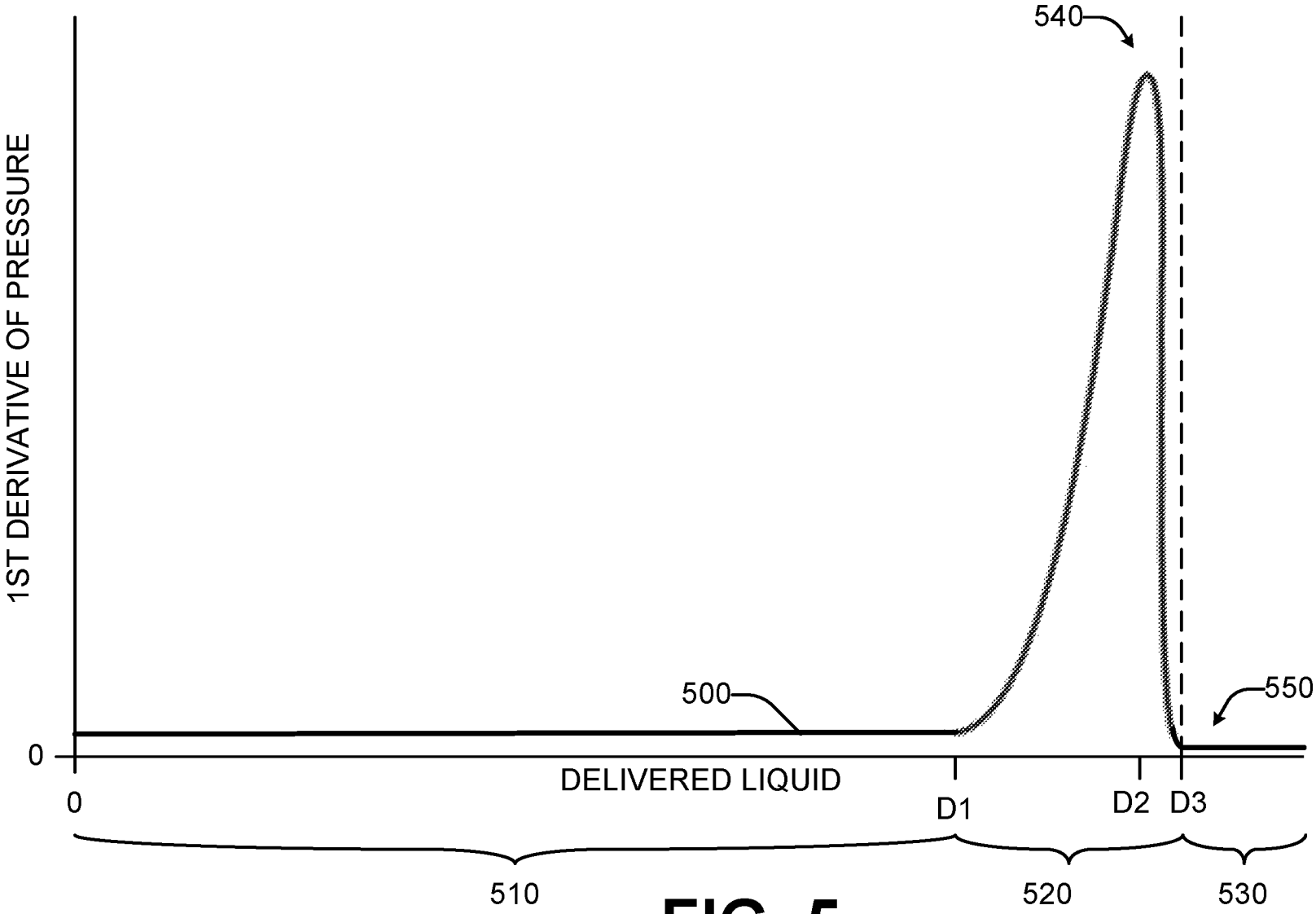
FIG. 5 is another example differential liquid/air pressure curve which represents the first derivative of differential liquid/air pressure versus the cumulative amount of liquid delivered from a liquid supply for an inkjet printer, in accordance with an example of the present disclosure.

Considering now another example differential liquid/air pressure curve, and with reference to FIG. 5, a curve 500 represents the first derivative of differential liquid/air pressure versus the cumulative amount of liquid delivered from the liquid supply. Stated another way, the curve 500 represents the change in differential liquid/air pressure versus the cumulative amount of liquid delivered from the liquid supply. In some examples, the segments 510, 520, 530 correspond to the segments 410, 420, 430 (FIG. 4), and the cumulative delivered liquid values D1, D2, and D3 of FIG. 5 correspond to those corresponding values of FIG. 4.

During the substantially linear segment 510, the differential liquid/air pressure has a slight, substantially constant increase, and so the first derivative of the differential liquid/air pressure has a small, substantially constant value. During the exponential segment 520, the first derivative of the differential liquid/air pressure rises to a peak value 540 (at a point where the curve 400 of FIG. 4 is steepest), and then drops back down. In some examples, the peak value occurs at or near cumulative delivered liquid value D2. During the constant pressure segment 530, the differential liquid/air pressure remains in a narrow range (defined by tolerance band T in the curve 400 of FIG. 4), and so the first derivative of the differential liquid/air pressure in the constant pressure segment 530 is at or near zero.

In one example, the characteristic of the first derivative curve 500 that is used to determine the out-of-liquid condition is the peak 540. The peak 540 is independent of sensor gain and DC offset, and can thus be accurately determined using even an uncalibrated sensor. Some amount of liquid still remains in the liquid supply when the peak 540 occurs. Thus using the peak 540 as the characteristic for determining the out-of-liquid condition can ensure that a printhead is not starved of liquid.

In another example, the characteristic of the curve 500 that is used to determine the out-of-liquid condition is the delivery from the liquid supply of a predefined additional amount of liquid after the peak 540 has occurred. The predefined additional amount of liquid may be a volume of liquid, a number of drops of liquid (where the volume per drop is known), a percentage of the amount of liquid in a full liquid supply, and/or another quantity. In some examples, the amount of liquid remaining in a particular liquid supply (or a particular type of liquid supply) when the peak 540 occurs is known. As a result printing can be allowed to continue for the predefined additional amount of liquid before declaring the out-of-liquid condition while still avoiding printhead starvation. This advantageously enables the amount of liquid stranded in the liquid supply to be reduced.

In a further example, the characteristic of the curve 500 that is used to determine the out-of-liquid condition is the detection of a zero or near-zero first derivative value 550 after the peak 540 has occurred, which occurs at or near delivered liquid value D3. This minimizes the amount of liquid stranded in the liquid supply, and may advantageously be used in situations where a printhead is resistant to liquid starvation damage and/or the inkjet printing device otherwise ensures that the printhead will avoid liquid starvation.

In operation, differential liquid/air pressure measurements are periodically obtained during the printing process, and correlated to a corresponding cumulative amount of liquid that has been delivered from the liquid supply at the time of the measurement, in a similar manner as has been explained heretofore with reference to FIG. 4. The first derivative of the differential liquid/air pressure measurements are calculated and paired with corresponding cumulative amounts of delivered liquid to form corresponding two-dimensional data points. In some examples, the first derivative is computed as the slope of a line between two differential liquid/air pressure measurements. In some examples, filtering (such as for example low-pass filtering) may be applied to the differential liquid/air pressure measurements, and/or the computed first derivatives, in order to reduce or eliminate noise.

Figure 6:
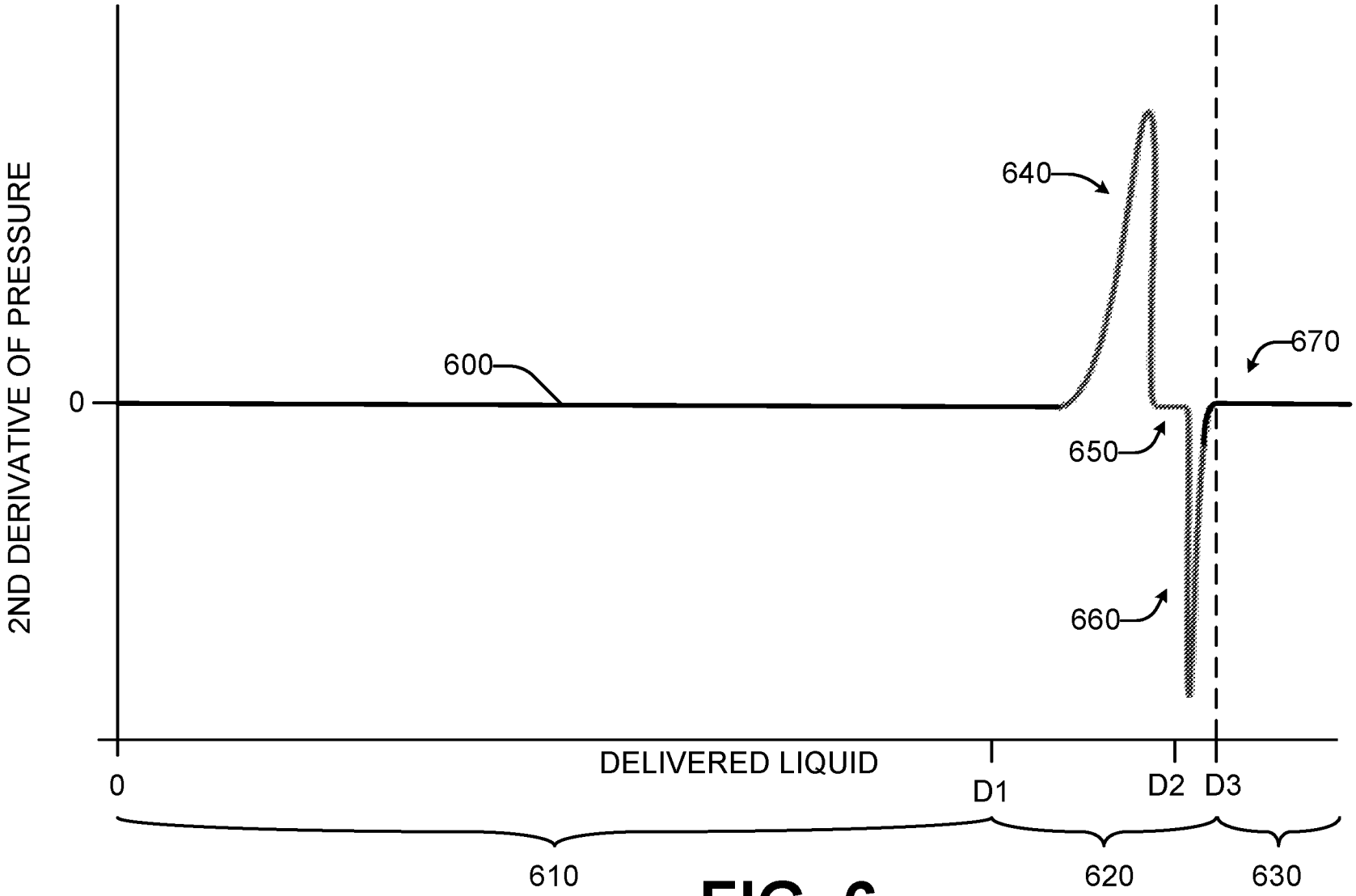
FIG. 6 is a further example differential liquid/air pressure curve which represents the second derivative of differential liquid/air pressure versus the cumulative amount of liquid delivered from a liquid supply for an inkjet printer, in accordance with an example of the present disclosure.

Considering now another example differential liquid/air pressure curve, and with reference to FIG. 6, a curve 600 represents the second derivative of differential liquid/air pressure versus the cumulative amount of liquid delivered from the liquid supply. Stated another way, the curve 600 represents the change in the rate of change of differential liquid/air pressure versus the cumulative amount of liquid delivered from the liquid supply. Stated yet another way, the curve 600 represents the slope of the curve 500 (FIG. 5). In some examples, the segments 610, 620, 630 correspond to the segments 410, 420, 430 (FIG. 4), and the cumulative delivered liquid values D1, D2, and D3 of FIG. 6 correspond to those corresponding values of FIG. 4.

During the substantially linear segment 610, the first derivative of the differential liquid/air pressure has a small, substantially constant value, and so the second derivative of the differential liquid/air pressure is a baseline value of substantially zero. During the exponential segment 620, a positive-going spike 640 in the second derivative of the differential liquid/air pressure is followed by a baseline crossing 650, followed by a negative-going spike 660 and a return to the baseline value 670. In some examples, the baseline crossing 650 occurs at or near cumulative delivered liquid value D2. In addition, while the second derivative is illustrated as remaining at the baseline crossing 650 for some duration of additional delivered ink, in other examples, the baseline crossing 650 may be instantaneous. During the constant pressure segment 630, the differential liquid/air pressure remains in a narrow range (defined by tolerance band T in the curve 400 of FIG. 4), and so the second derivative of the differential liquid/air pressure in the constant pressure segment 630 is at or near the baseline value 670.

In various examples, the characteristic of the second derivative curve 600 that is used to determine the out-of-liquid condition is one of the positive-going spike 640, the baseline crossing 650, the negative-going spike 660, and the baseline value 670. For the positive-going spike 640 or the negative-going spike 660, the determinative point for out-of-liquid detection may be the peak value, the leading edge, the trailing edge, or another point of the spike. In some examples, the characteristic may be defined by the last in a sequence of certain ones of the features 640, 650, 660, 670. In one example, the characteristic is the negative-going spike 660 of the curve below the baseline preceded by a positive-going spike 640 above the baseline. In another example, the characteristic is the return to the baseline 670 following a negative-going spike 660. A variety of such composite characteristics may be defined and utilized to determine the out-of-liquid condition.

In addition, the particular feature or sequence of features 640, 650, 660, 670 which define the characteristic of the second derivative curve 600 can be used to specify the amount of liquid that will be stranded in the liquid supply when the out-of-liquid condition is declared. For example, more liquid will be stranded in the liquid supply if the characteristic used to determine the out-of-liquid condition is based on the positive-going spike 640 rather than the negative-going spike 660. Little or no liquid will be left stranded if the baseline point 670 preceded by a negative-going spike 660 is the characteristic. Thus usage of a second derivative characteristic allows the amount of stranded liquid at the point out-of-liquid is declared to be adjusted without resorting to calculating additional amount of delivered liquid after a particular feature has occurred.

In operation, differential liquid/air pressure measurements are periodically obtained during the printing process, and correlated to a corresponding cumulative amount of liquid that has been delivered from the liquid supply at the time of the measurement, in a similar manner as has been explained heretofore with reference to FIG. 4. The second derivative of the differential liquid/air pressure measurements are calculated and paired with corresponding cumulative amounts of delivered liquid to form corresponding two-dimensional data points. In some examples, the second derivative is computed as the slope of the first derivative curve 500 (FIG. 5), using repetitive application of the technique used to calculate the first derivative. In some examples, filtering (such as for example low-pass filtering) may be applied to the differential liquid/air pressure measurements, and/or the computed second derivatives, and/or intermediate computation steps such as the computed first derivative, in order to reduce or eliminate noise.

Figure 3:
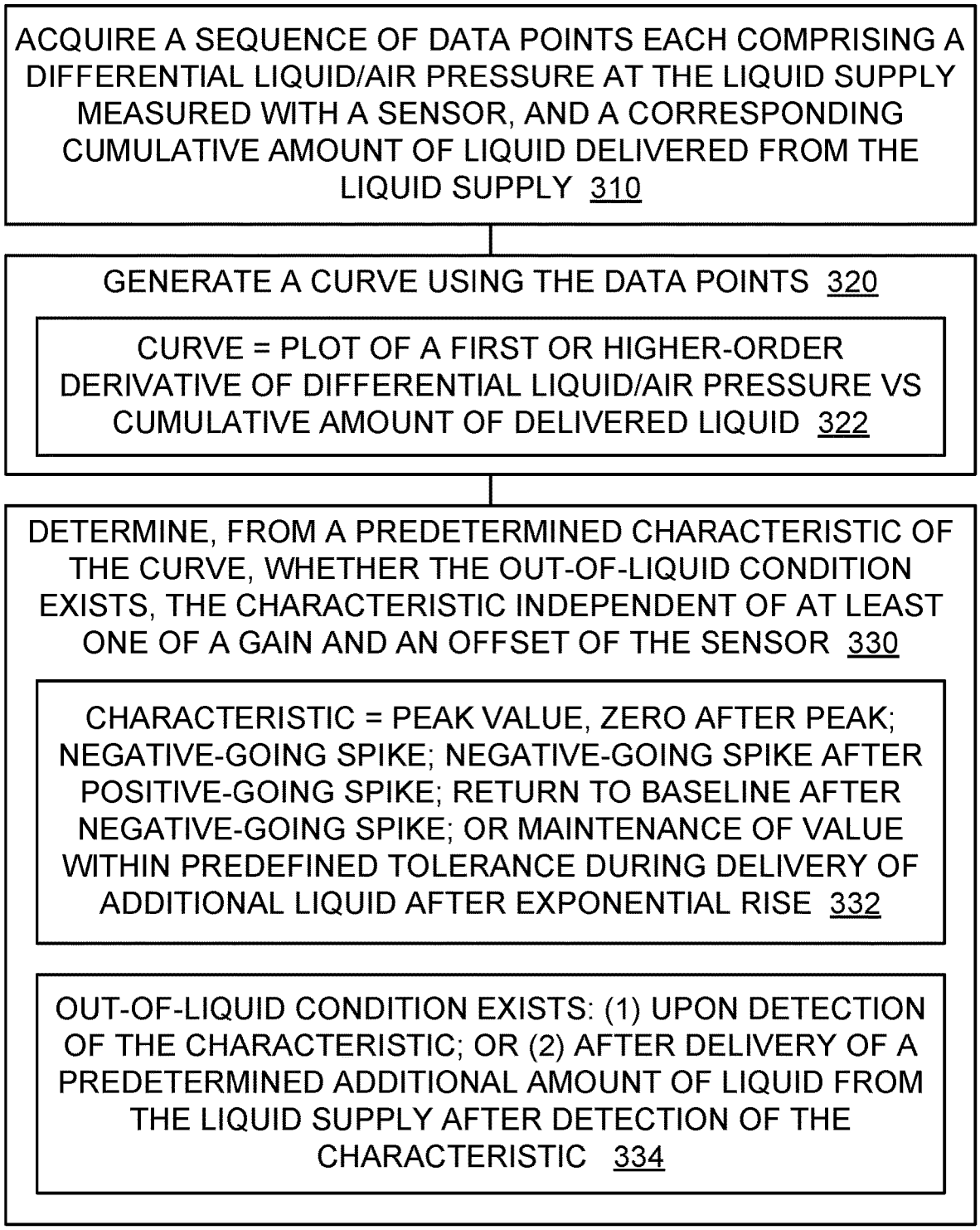
FIG. 3 is a flowchart in accordance with an example of the present disclosure of another method for determining an out-of-liquid condition of a liquid supply for an inkjet printer.
Figure 7:
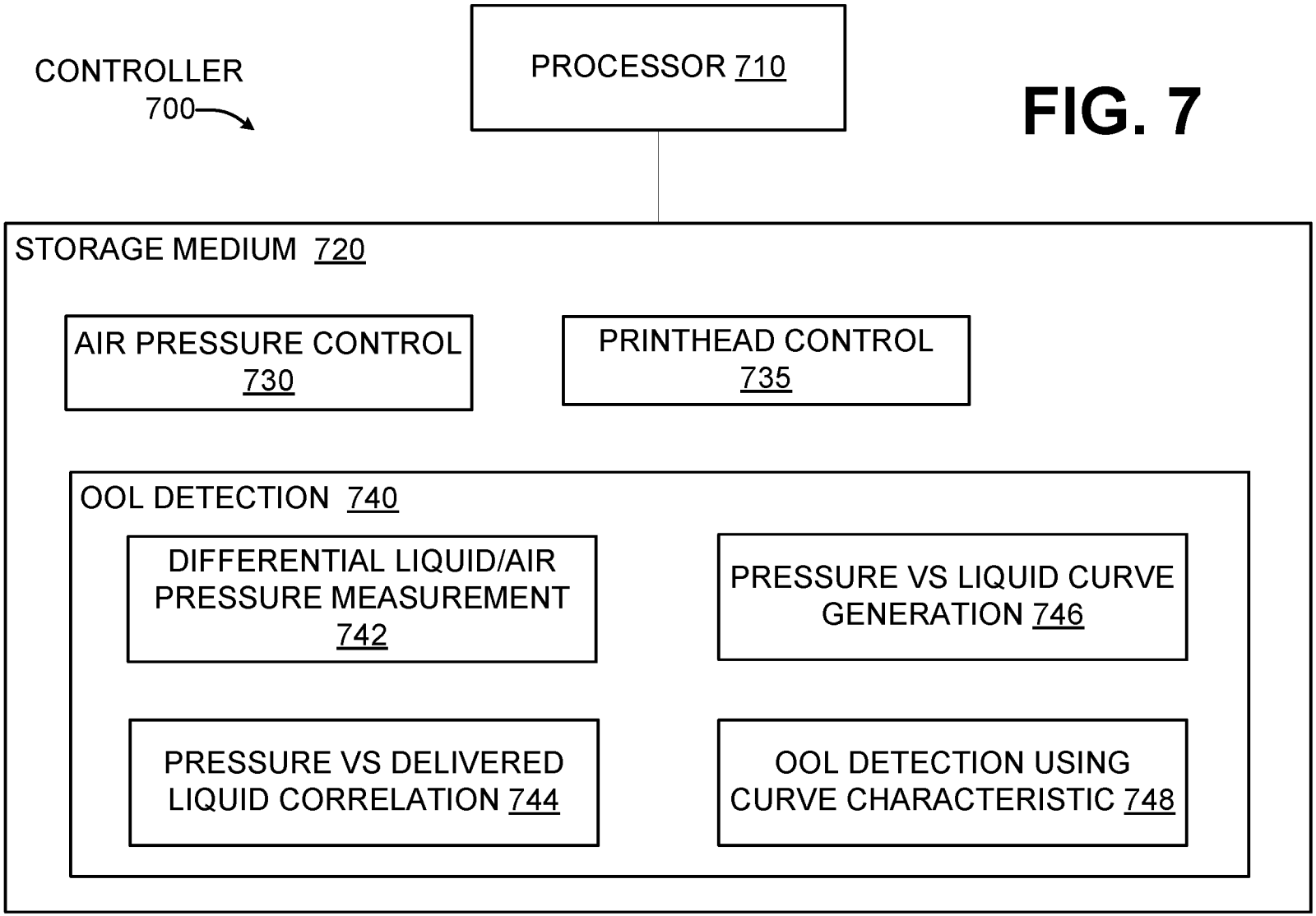
FIG. 7 is a schematic representation of example controller usable with the inkjet printing device of FIGS. 1A-1B, in accordance with an example of the present disclosure.

Considering now one example controller usable with an inkjet printing device, and with reference to FIG. 7, a controller 700 may be employed as the controller 150 of the inkjet printing device 100 (FIGS. 1A-1B). The controller 700 includes a processor 710 and a computer-readable storage medium 720. Executable program instructions are stored on the storage medium 720 to perform, inter alia, determination of an out-of-liquid condition of the liquid supply 110 (FIGS. 1A-1B). In examples, the controller 700 implements the method for determining an out-of-liquid condition of a liquid supply for an inkjet printer of FIG. 2 and/or FIG. 3.

The storage medium 720 may include different forms of memory including semiconductor memory devices such as DRAM, or SRAM, Erasable and Programmable Read-Only Memories (EPROMs), Electrically Erasable and Programmable Read-Only Memories (EEPROMs) and flash memories; magnetic disks such as fixed, floppy and removable disks; other magnetic media including tape; optical media such as Compact Disks (CDs) or Digital Versatile Disks (DVDs); and/or other types of computer-readable storage devices. In some examples, the executable instructions are organized into blocks 730-748, each of which may represent a module (also referred to as a code subroutine, a code function, or an "objects" in object-oriented programming).

An air pressure control block 730 controls the air pump to pressurize an air cavity (such as air cavity 116, FIGS. 1A-1B) and maintain it at a desired pressure. In some examples, a printhead control block 735 controls the ejection of liquid drops from a printhead (such as printhead 120, FIGS. 1A-1B) to print a requested pattern of drops (e.g. an image) on a print medium with the inkjet printing device. In other examples, the printhead control block 735 may be stored on another storage medium (not shown) and/or executed by another processor (not shown).

An out-of-liquid detection block 740 detects the occurrence of an out-of-liquid condition in a liquid supply. The block 740 includes a differential liquid/air pressure measurement block 742 which periodically measures a differential liquid/air pressure at a liquid supply of an inkjet printing device during printing. In some examples, the pressure is the differential liquid/air pressure between a liquid channel and an air channel (such as liquid channel 160 and air channel 170, FIGS. 1A-1B), as measured by a sensor (such as differential liquid/air pressure sensor 140, FIGS. 1A-1B).

The block 740 also includes a differential pressure versus delivered liquid correlation block 744 which correlates each measured pressure to a cumulative amount of liquid delivered from the liquid supply. The block 740 further includes a differential pressure versus delivered liquid curve generation block 746 which generates a curve from the measured pressures and the correlated cumulative amounts of delivered liquid.

The block 740 additionally includes an out-of-liquid detection block 748 that determines whether and/or when an out-of-liquid condition of the liquid supply occurs. The determination is performed using a characteristic of the curve. In some examples, the characteristic is different from a predefined differential liquid/air pressure threshold value. In some examples, the characteristic is independent of at least one of a gain and a DC offset of the sensor which measures the differential liquid/air pressure.

In some examples, at least one block discussed herein is automated. In other words, apparatus, systems, and methods occur automatically. As defined herein and in the appended claims, the terms "automated" or "automatically" (and like variations thereof) shall be broadly understood to mean controlled operation of an apparatus, system, and/or process using computers and/or mechanical/electrical devices without the necessity of human intervention, observation, effort and/or decision.

From the foregoing it will be appreciated that the inkjet printing device, method, and storage medium provided by the present disclosure represent a significant advance in the art. Although several specific examples have been described and illustrated, the disclosure is not limited to the specific methods, forms, or arrangements of parts so described and illustrated. This description should be understood to include all combinations of elements described herein, and claims may be presented in this or a later application to any combination of these elements. The foregoing examples are illustrative, and different features or elements may be included in various combinations that may be claimed in this or a later application. Unless otherwise specified, operations of a method claim need not be performed in the order specified. Similarly, blocks in diagrams or numbers should not be construed as operations that proceed in a particular order. Additional blocks/operations may be added, some blocks/operations removed, or the order of the blocks/operations altered and still be within the scope of the disclosed examples. Further, methods or operations discussed within different figures can be added to or exchanged with methods or operations in other figures. Further yet, specific numerical data values (such as specific quantities, numbers, categories, etc.) or other specific information should be interpreted as illustrative for discussing the examples. Such specific information is not provided to limit examples. The disclosure is not limited to the above-described implementations, but instead is defined by the appended claims in light of their full scope of equivalents. Where the claims recite "a" or "a first" element of the equivalent thereof, such claims should be understood to include incorporation of at least one such element, neither requiring nor excluding two or more such elements. Where the claims recite "having", the term should be understood to mean "comprising".

What is claimed is:

1. A method for determining an out-of-liquid condition of a liquid supply for an inkjet printer, comprising:

acquiring, during printing, a sequence of data points, each data point comprising a differential liquid/air pressure at the liquid supply measured with a sensor and a corresponding cumulative amount of liquid delivered from the liquid supply;

generating a curve using the data points; and determining, from a predetermined characteristic of the curve, whether the out-of-liquid condition exists, the characteristic independent of at least one of a gain and an offset of the sensor.

2. The method of claim 1, wherein the curve corresponds to a plot of a first or higher-order derivative of the differential liquid/air pressure versus the cumulative amount of delivered liquid.

3. The method of claim 1, wherein the out-of-liquid condition is determined to exist after delivery of a predetermined additional amount of liquid from the liquid supply after detection of the characteristic of the curve.

4. The method of claim 1, wherein the characteristic is a peak value of the curve.

5. The method of claim 1, wherein the characteristic is a baseline value of the curve following a peak value of the curve.

6. The method of claim 1, wherein the characteristic is a negative-going spike of the curve below a baseline.

7. The method of claim 1, wherein the characteristic is a negative-going spike of the curve below a baseline preceded by a positive-going spike of the curve above the baseline.

8. The method of claim 1, wherein the characteristic is a return to a baseline following a negative-going spike of the curve below the baseline.

9. The method of claim 1, wherein the characteristic is the measured differential liquid/air pressure remaining constant during printing, within a predefined pressure tolerance, after an exponential rise above a linear range.

10. An inkjet printing device, comprising:

a liquid channel to deliver liquid from a liquid supply to a printhead;

an air pump to pressurize the liquid supply through an air channel; and a controller coupled to the liquid channel and the air channel to periodically measure, during printing, a differential liquid/air pressure between the liquid channel and the air channel using a differential pressure sensor disposed at the liquid supply, the sensor having an indeterminate gain and offset, correlate each measured pressure to a cumulative amount of liquid delivered from the liquid supply, generate a curve from the measured pressures and the correlated cumulative amounts of delivered ink, and determine, from a predetermined characteristic of the curve, when an out-of-liquid condition of the liquid supply occurs.

11. The printing device of claim 10, wherein the curve is a plot of the differential liquid/air pressure versus the cumulative amount of delivered ink, and wherein the out-of-liquid condition is determined to exist if the differential liquid/air pressure remains within a predefined tolerance of a value during the delivery of a predetermined additional amount of liquid from the liquid supply, after an exponential rise in the differential liquid/air pressure.

12. The printing device of claim 10, wherein the predetermined characteristic is different from a predefined differential liquid/air pressure threshold value.

13. The printing device of claim 10, wherein the curve a plot of a first or higher-order derivative of the differential liquid/air pressure versus the cumulative amount of delivered liquid.

14. A non-transitory computer-readable storage medium having an executable program stored thereon, wherein the program instructs a processor to:

periodically measure a differential liquid/air pressure at a liquid supply of an inkjet printing device during printing;

correlate each measured pressure to a cumulative amount of liquid delivered from the liquid supply;

generate a curve from the measured pressures and the correlated cumulative amounts of delivered ink; and determine whether an out-of-liquid condition of the liquid supply occurs using a characteristic of the curve, the characteristic different from a predefined differential liquid/air pressure value.

15. The medium of claim 14, wherein the characteristic is independent of at least one of a gain and an offset of a sensor which measures the differential liquid/air pressure.

* * * * *